US007485820B2

(12) United States Patent
Zhang et al.

(10) Patent No.: US 7,485,820 B2
(45) Date of Patent: Feb. 3, 2009

(54) BUTTON ASSEMBLY

(75) Inventors: Yue-Hai Zhang, Shenzhen (CN); Chien-Li Tsai, Tu-Cheng (TW); Wen-Kang Lo, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,575

(22) Filed: Aug. 25, 2006

(65) Prior Publication Data

US 2007/0089971 A1 Apr. 26, 2007

(51) Int. Cl.
*H01H 13/00* (2006.01)

(52) U.S. Cl. ..... 200/296; 200/343

(58) Field of Classification Search ..... 200/293, 200/296, 341–345, 520; 341/22; 345/156, 345/168, 169, 184
See application file for complete search history.

(56) References Cited

U.S. PATENT DOCUMENTS 5,552,956 A * 9/1996 Pasquarette et al. ..... 361/680
5,813,520 A * 9/1998 Reier et al. ..... 200/343
5,990,432 A * 11/1999 Kuroda ..... 200/343
6,148,183 A * 11/2000 Higdon et al. ..... 455/575.1
6,160,232 A * 12/2000 Lin ..... 200/341
6,914,206 B2 * 7/2005 Mukougawa ..... 200/556
6,960,734 B1 * 11/2005 Park ..... 200/343
6,964,532 B1 * 11/2005 Lu ..... 400/490
7,002,086 B2 * 2/2006 Fuji ..... 200/305
7,019,237 B2 * 3/2006 Hong ..... 200/296
7,173,205 B2 * 2/2007 Yamamoto ..... 200/343

FOREIGN PATENT DOCUMENTS

CN 99236688.7 6/2000

* cited by examiner

*Primary Examiner*—Michael A Friedhofer
(74) *Attorney, Agent, or Firm*—Wei Te Chung

(57) ABSTRACT

A button assembly includes a bezel, an elastic member, and a button. The bezel defines a through hole. The elastic member forms a locating portion on an end thereof, and a mounting portion on the other end thereof. The locating portion is movably mounted to the bezel. The button is assembled on the mounting portion of the elastic member. The button includes a manipulating section extending through the through hole of the bezel.

18 Claims, 3 Drawing Sheets

BUTTON ASSEMBLY

DESCRIPTION

1. Field of the Invention

The present invention relates to button assemblies, and more particularly to a button assembly having an expediently assembled button.

2. Description of Related Art

Typically, an electronic device, such as a notebook computer, has a plurality of switches arranged thereon for starting or closing some functions thereof. Buttons are usually assembled on a bezel of the notebook computer for triggering the corresponding switches. Generally, a plurality of through-holes is defined in the bezel with each through-hole corresponding to a button. Each button extends through a corresponding through-hole of the bezel, and is assembled on the bezel by an elastic tab. Each elastic tab defines a pair of fixing holes. A pair of posts protrudes from an inner surface of the bezel adjacent to each through-hole. The posts extend through the corresponding through-holes. The elastic tabs are fixed to the corresponding posts by hot melting. However, melting the posts needs special tools. Furthermore, it is hard to control the melting temperature and time.

What is needed, therefore, is a button assembly having an expediently assembled button.

SUMMARY OF THE INVENTION

An exemplary button assembly includes a bezel, an elastic member, and a button. The bezel defines a through hole. The elastic member forms a locating portion on an end thereof, and a mounting portion on the other end thereof. The locating portion is movably mounted to the bezel. The button is assembled on the mounting portion of the elastic member. The button includes a manipulating section extending through the through hole of the bezel.

Other advantages and novel features will become more apparent from the following detailed description of preferred embodiment when taken in conjunction with the accompanying drawings, in which:

DETAILED DESCRIPTION OF THE INVENTION

Figure 1:
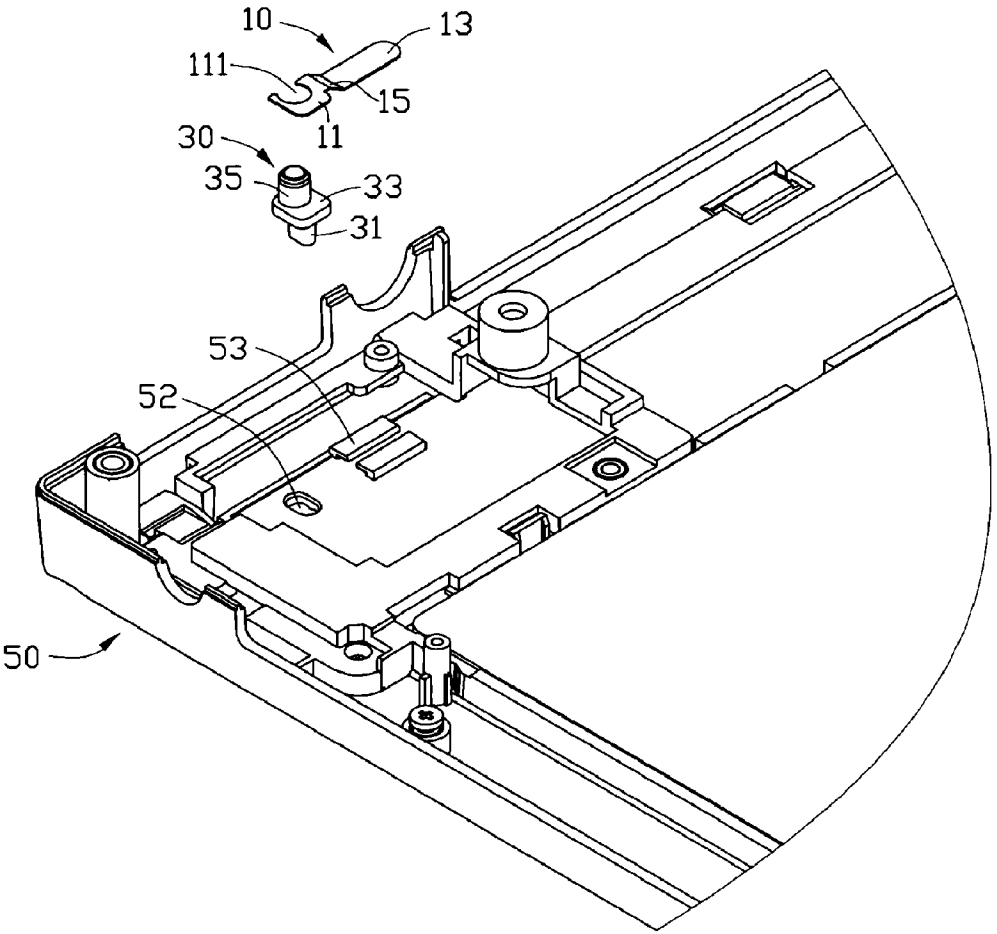
FIG. 1 is an exploded, isometric view of a button assembly in accordance with a preferred embodiment of the present invention.

Referring to FIG. 1, a button assembly in accordance with a preferred embodiment of the present invention includes a bezel 50 of an electronic device such as a notebook computer, an elastic member 10, and a button 30.

The bezel 50 defines a through hole 52 therein. A pair of parallel L-shaped fixing tabs 53 with raised portions protrudes from an inner surface of the bezel 50, the raised portions cooperatively defining a receiving space thereunder. The fixing tabs 53 are located adjacent the through hole 52.

The elastic member 10 is generally thin and rectangular. The elastic member 10 includes a mounting portion 11 at one end thereof, a locating portion 13 adjacent to the mounting portion 11, and a slanting portion 15 connected between the mounting portion 11 and the locating portion 13. A cutout 111 is defined in the mounting portion 11. The locating portion 13 corresponds to the receiving space formed under the fixing tabs 53 to be received therein.

The button 30 includes a manipulating section 31, a block shaped base section 33, and a triggering section 35. The base section 33 is configured so that it will not fit into the through hole 52 of the bezel 50. For example, in the embodiment as shown in FIG. 1, the base section 33 has a cross-sectional area larger than that of the through hole 52. The manipulating section 31 extends from the base section 33 corresponding to the through hole 52 of the bezel 50. The triggering section 35 protrudes from the base section 33, opposite to the manipulating section 31.

Figure 2:
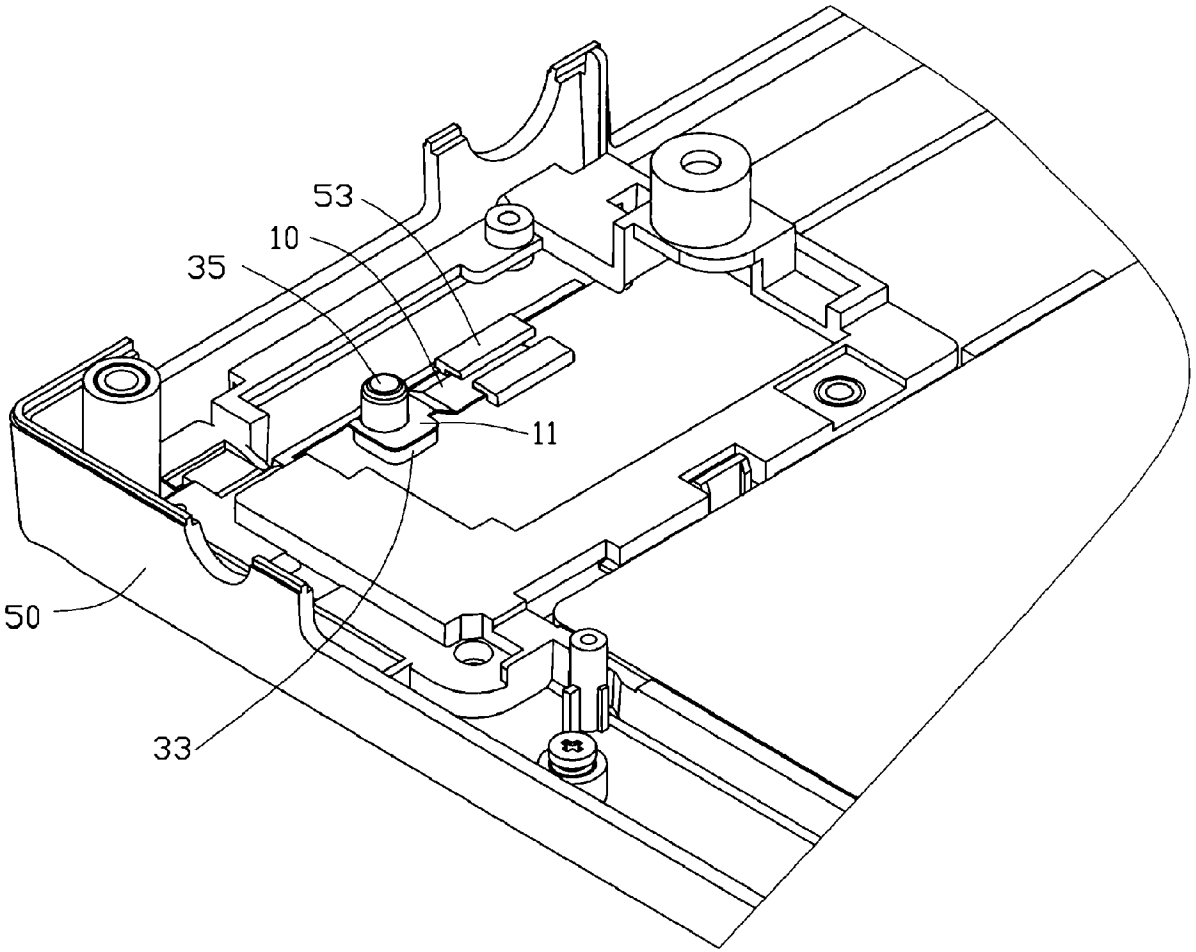
FIG. 2 is an assembled view of FIG. 1.
Figure 3:
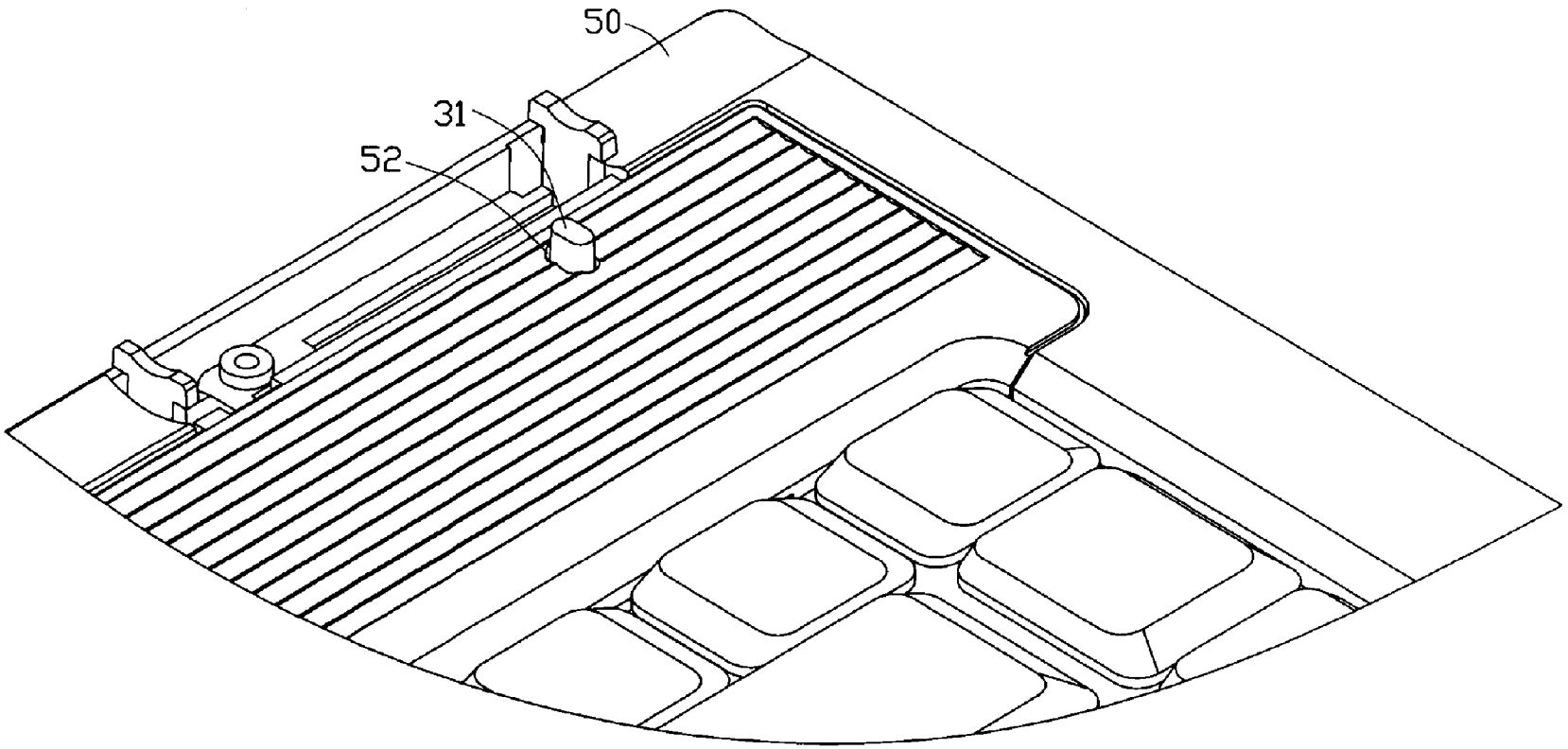
FIG. 3 is an inverted view of FIG. 2.

Referring also to FIGS. 2 and 3, in assembly, sides of the cutout 111 of the elastic member 10 catch the triggering section 35 of the button 30. The mounting portion 11 of the elastic member 10 abuts against a surface of the base section 33. The locating portion 13 of the elastic member 10 is inserted into the receiving space formed under the fixing tabs 53 of the bezel 50. The elastic member 10 is resiliently distorted as the manipulating section 31 of the button 30 slides on the bezel 50. When the manipulating section 31 aligns with the through hole 52 of the bezel 50, the elastic member 10 restores. The manipulating section 31 is inserted into and penetrates beyond an edge of through hole 52. Thus, the button 30 is assembled on the bezel 50.

In use, the manipulating section 31 of the button 30 is pressed. The button 30 moves in to trigger a switch of the notebook. Meanwhile, the elastic member 10 is resiliently distorted. When the button 30 is released, the elastic member 10 restores to drive the button 30 back.

In an alternate embodiment, the mounting portion 11 of the elastic member 10 can be integrally formed on the button 30.

The button assembly can be used in other electronic devices, such as laptop computers, desktop computers, personal digital assistants, televisions, and so on.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A button assembly, comprising:

a bezel defining a through hole;

an elastic member comprising a locating portion on an end thereof, and a mounting portion on the other end thereof, the locating portion movably mounted to the bezel; and a button assembled on the mounting portion, the button comprising a manipulating section extending through the through hole of the bezel;

wherein the button further comprises a base section and a triggering section, the elastic member defines a cutout in the mounting portion thereof, sides bounding the cutout of the elastic member catch the triggering section, and the mounting portion of the elastic member abuts against a surface of the base section of the button.

2. The button assembly as claimed in claim 1, wherein the bezel forms a pair of fixing tabs, the locating portion of the elastic member is inserted into a receiving space formed under portions of the fixing tabs.

3. The button assembly as claimed in claim 2, wherein the fixing tabs of the bezel are L-shaped.

4. The button assembly as claimed in claim 1, wherein the manipulating section and the triggering section of the button extend from two opposite surfaces of the base section, respectively.

5. The button assembly as claimed in claim 1, wherein a cross-sectional area of the base section of the button is greater than that of the through hole of the bezel.

6. The button assembly as claimed in claim 1, wherein the elastic member further comprises a slanting portion connected between the locating portion and the mounting portion.

7. A button assembly comprising;

a main body defining a through hole;

a button attached to an inside of the main body, the button comprising a manipulating section, a base section and a triggering section, the manipulating section extending out of the main body via the through hole, the button being moveable from an original position to a pressed position under a condition that a force is applied on the manipulating section;

an elastic member detachably secured to the inside of the main body, the elastic member comprising a mounting portion defining a cutout therein, sides bounding the cutout of the elastic member catching the triggering section of the button for returning the button from the press position to the original position when the force is withdrawn, and the mounting portion of the elastic member abutting against a surface of the base section of the button.

8. The button assembly as claimed in claim 7, wherein a pair of fixing tabs extends from the inside of the main body with a receiving space formed between the fixing tabs and the inside of the main body, and the elastic member comprises a locating portion slidably received in the receiving space.

9. The button assembly as claimed in claim 8, wherein the elastic member further comprises a slant section, the locating section and the mounting section extending from opposite ends of the slant section respectively.

10. The button assembly as claimed in claim 9, wherein the button forms a step, the mounting portion of the elastic member grips the button at the step.

11. The button assembly as claimed in claim 10, wherein the base section and the triggering section cooperatively form the step, the manipulating section extending from the base section opposing the triggering section, the base section having a size larger than that of the through hole in one direction perpendicular to the through hole.

12. The button assembly as claimed in claim 7, wherein the elastic member and the button are integrally formed.

13. A button assembly comprising;

a bezel defining a through hale therein, and forming a pair of fixing tabs at an inner surface thereof, the fixing tabs forming two receiving spaces with the inner surface of the bezel;

an elastic piece comprising a locating portion movably mounted in the receiving spaces in such a manner that the locating portion is movable in said receiving spaces in a direction parallel to the inner surface of the bezel but is blocked by the fixing tabs from vertically escaping from the bezel, and a mounting portion cantileveredly extending from the locating portion; and a button attached to the mounting portion of the elastic portion and exposing from the through hole of the bezel.

14. The button assembly as claimed in claim 13, wherein the mounting portion of the elastic piece defines a cutout therein, the button comprises a triggering portion received in the cutout, a manipulating portion exposed out of the bezel, and an enlarged base portion between the trigger portion and the manipulating portion to be sandwiched between the mounting portion of the elastic portion and the inner surface of the bezel.

15. The button assembly as claimed in claim 13, wherein the button is detachably attached to the mounting portion of the elastic portion.

16. The button assembly as claimed in claim 13, wherein the button is moveable inward or outward along the through hole of the bezel to cause the locating portion moving toward or away from the button along the receiving spaces.

17. The button assembly as claimed in claim 13, wherein the mounting portion is offset from the locating portion in the direction parallel to the inner surface of the bezel such that a distance in another direction along which the through hole extends, is formed therebetween.

18. The button assembly as claimed in claim 13, wherein the fixing tabs of the bezel are L-shaped and opposite to each other, and the two receiving spaces are parallel to the inner surface of the bezel.

* * * * *